US006655302B1

(12) United States Patent
Ross

(10) Patent No.: US 6,655,302 B1
(45) Date of Patent: Dec. 2, 2003

(54) LOBBY BANKING FINANCIAL SECURITY TRANSACTION CHAMBER

(76) Inventor: Juande Ross, 2715 Chattonooga Loup, Ardmore, OK (US) 73401

( * ) Notice: Subject to any disclaimer, the term of this patent is extended or adjusted under 35 U.S.C. 154(b) by 0 days.

(21) Appl. No.: 09/505,531

(22) Filed: Feb. 22, 2000

(51) Int. Cl.[7] ..... E04H 9/00

(52) U.S. Cl. ..... 109/2; 109/5; 109/10; 109/19; 109/21.5

(58) Field of Search ..... 109/2–7, 9, 10–13, 109/19, 21.5; 902/30, 31, 33, 35; 52/79.1

(56) References Cited

U.S. PATENT DOCUMENTS

| | | | | | |
|---|---|---|---|---|---|
| 1,890,671 | A | * | 12/1932 | Bridgeman | 109/2 X |
| 4,157,071 | A | * | 6/1979 | King | 109/11 X |
| 4,380,201 | A | * | 4/1983 | Dion | 109/5 X |
| 4,586,441 | A | * | 5/1986 | Zekich | 109/6 X |
| 4,741,275 | A | * | 5/1988 | Lewiner et al. | 109/7 |
| 5,217,088 | A | * | 6/1993 | Dallman | 186/37 |
| 5,311,166 | A | * | 5/1994 | Frye | 109/6 X |
| 5,400,722 | A | * | 3/1995 | Moses et al. | 109/2 |
| 5,512,891 | A | * | 4/1996 | Kang | 340/941 |
| 5,769,011 | A | * | 6/1998 | Daniel | 109/2 X |
| 5,780,825 | A | * | 7/1998 | Sato et al. | 235/379 |
| 5,860,371 | A | * | 1/1999 | Shelley | 109/12 X |
| 5,970,888 | A | * | 10/1999 | Sheppard | 109/10 |
| 5,992,094 | A | * | 11/1999 | Diaz | 109/6 X |
| 6,158,655 | A | * | 12/2000 | DeVries, Jr. et al. | 235/380 |

FOREIGN PATENT DOCUMENTS

| | | | | |
|---|---|---|---|---|
| DE | 2317047 | * | 10/1974 | 109/3 |
| FR | 2311162 | * | 12/1976 | 109/5 |
| FR | 2409364 | * | 7/1979 | 109/7 |
| FR | 2590311 | * | 5/1987 | 109/5 |
| NL | 7512938 | * | 5/1976 | 109/2 |

* cited by examiner

*Primary Examiner*—Suzanne Dino Barrett
(74) *Attorney, Agent, or Firm*—Robert E. Massa

(57) ABSTRACT

A primary communication channel for drive-in customers performing financial transactions with bank teller while customers are in their cars from the drive-through lanes. This telecommunication system is a conduit secured line telephone receiver for each separate lane and is interconnected with corresponding headsets. The total design prevents cross-talk, amplified overhead conversations to other customers in their cars or to persons walking perimeter of drive-through banking areas. Each customer is provided with a complete primary communication channel for financial transactions Preventions of customers being identified as potential victims of financial exploitations through car tag associations with amplified conversations. Improved apprehension of person attempting to rob bank from bank teller's transaction window of drive-in area.

1 Claim, 13 Drawing Sheets

LOBBY BANKING FINANCIAL SECURITY TRANSACTION CHAMBER

BACKGROUND OF INVENTION

1. Field of Invention

This invention relates to a confidential financial security banking system for banking consumers. Specifically, to an improved banking security system to protect the communication of customers requesting financial transactions of services from or with bank-tellers in the lobby of banks and from drive-in/drive-through banking lanes.

2. Related Art

Originally; and currently, persons entering the lobby of any banking institutions, must go directly to the bank-teller's window to communicate their transactions, while doing this financial transaction, other persons are constantly entering the bank lobby. Each person stands directly behind each other; thus forming a "waiting-line" to perform similar financial transactions of business from the bank-teller. The second or third person in the "waiting-line" has a clear opportunity to "listen" to and observe the customers financial transactions. The current banking security system does not provide any secured communications of the customers financial transactions to keep other banking customers from listening to conservations the customers are discussing with the bank tellers. The current system allows for open and unprotected communications and for banking customers to be easily identified as potential victims of financial exploitation's or become extorted.

It is well known throughout the world; that the banking consumers-population is consistently increasing, that financial exploitations, extortations and bank robbers are also increasing. There is not a general method of prior art addressing these problems with solutions within the entire banking industries. Nor, is there a general method of an anti-theft invention of this nature to protect banking personnel and banking consumers.

3. Summary of Invention

This invention provides an anchored steel framed structural chamber of Paltech paneled construction, mirrored on the outside, 15'5" L, 6'5" W, with electronic sliding doors of 3' wide. This structural chamber is easily anchored within the lobby of bank directly in front of each bank teller's transaction area. Bank teller controls electronic opening and closure of sliding doors, permitting only one customer to enter and exit at a time to perform financial transactions.

The advantages of this invention provides a protected financial transaction between customer and bank teller, prevents other "customers waiting in line" within the bank lobby from listening to previous customer's financial transaction, and lip reading of customer's financial transaction is also eliminated. An additional advantage of this invention ensures banking customers performing financial transaction with teller from being identified as targeted victims for financial exploitation's or extortion by observant perpetrators waiting in the bank lobby.

It is also well known throughout the world that as the population continues to ages, most consumers will become "hearing impaired" and consequently they will talk louder. The U.S. Census Population Graph below, indicates projected growth of age 65+ in millions to year 2050."[1] The U.S. Census provides opportunities of marking progress of the consumer-population and identifies growth of every interest in this society. Therefore, a clear potential for financial exploitation's and extortion's will increase proportionally with this growth.

[1] Data Base News in Aging. U.S. Census Bureau. The Official Statistics. August, 17. htt//blue census gov/search/cigi/s

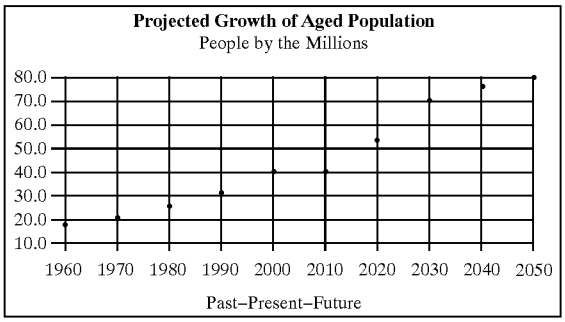

A further advantage of this invention eliminates accessibility for perpetrators to rob banking institutions, and provides immediate apprehension of any person attempting to rob a bank from within lobby of bank after entering structural chamber to request any type of financial transaction.

This invention for banking-lobby financial transaction is TDDY equipped at Bank teller's transaction counter for deaf-consumer population and is wheelchair accessible.

An additional advantage of this invention provides for customer from drive-in, drive-through banking lanes to initiate and or communicate with bank teller from their car without conversations being heard by other customers waiting in their cars or by persons walking around the parameters of drive-through banking lane areas. A telephone receiver is interconnected with money depository module and has a retractable flexible conduit card attached to phone receiver with an extension capacity for customer to hold phone receiver, while in a comfortable sitting position in a car to perform conversation of financial transaction. Bank teller at drive-in window transaction has a wireless system communication headset which provides a complete private conversation channel between drive-in, drive-through banking customer with bank teller.

This total invention and its object provides protection for banking personnel, prevents endangerment to banking consumers and increases levels of security as their conversations with bank tellers are not being heard by other customers.

Further advantages of this invention will become better understood by reference to the detailed description and viewed drawings.

DETAILED DESCRIPTION OF INVENTION

In describing preferred elements of this invention, it is to be understood that each specific element includes all technical equivalents which operates in a similar manner to accomplish a similar purpose.

Figure 1A:
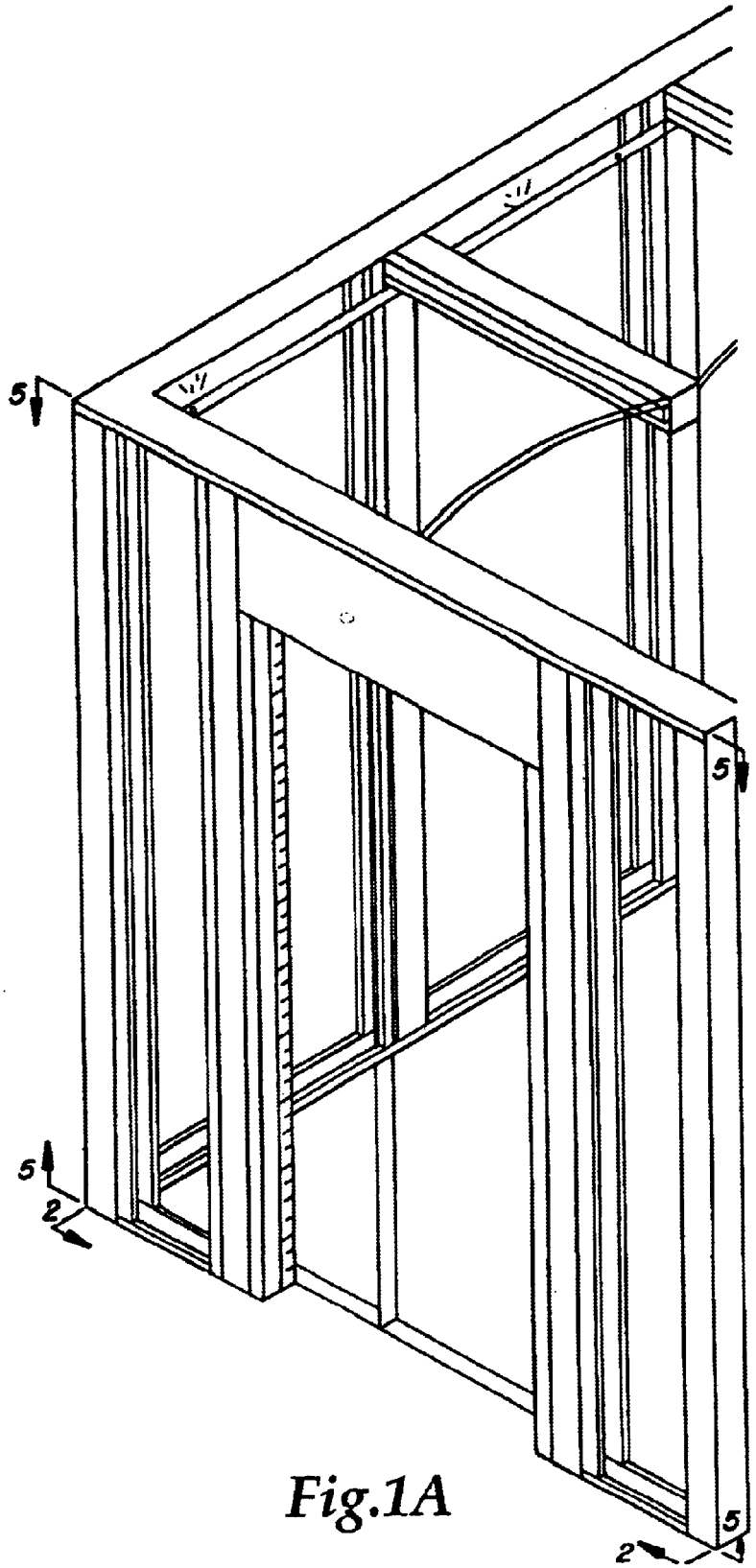
FIG. 1A is a parallel view of exterior entryway security chamber.
Figure 1B:
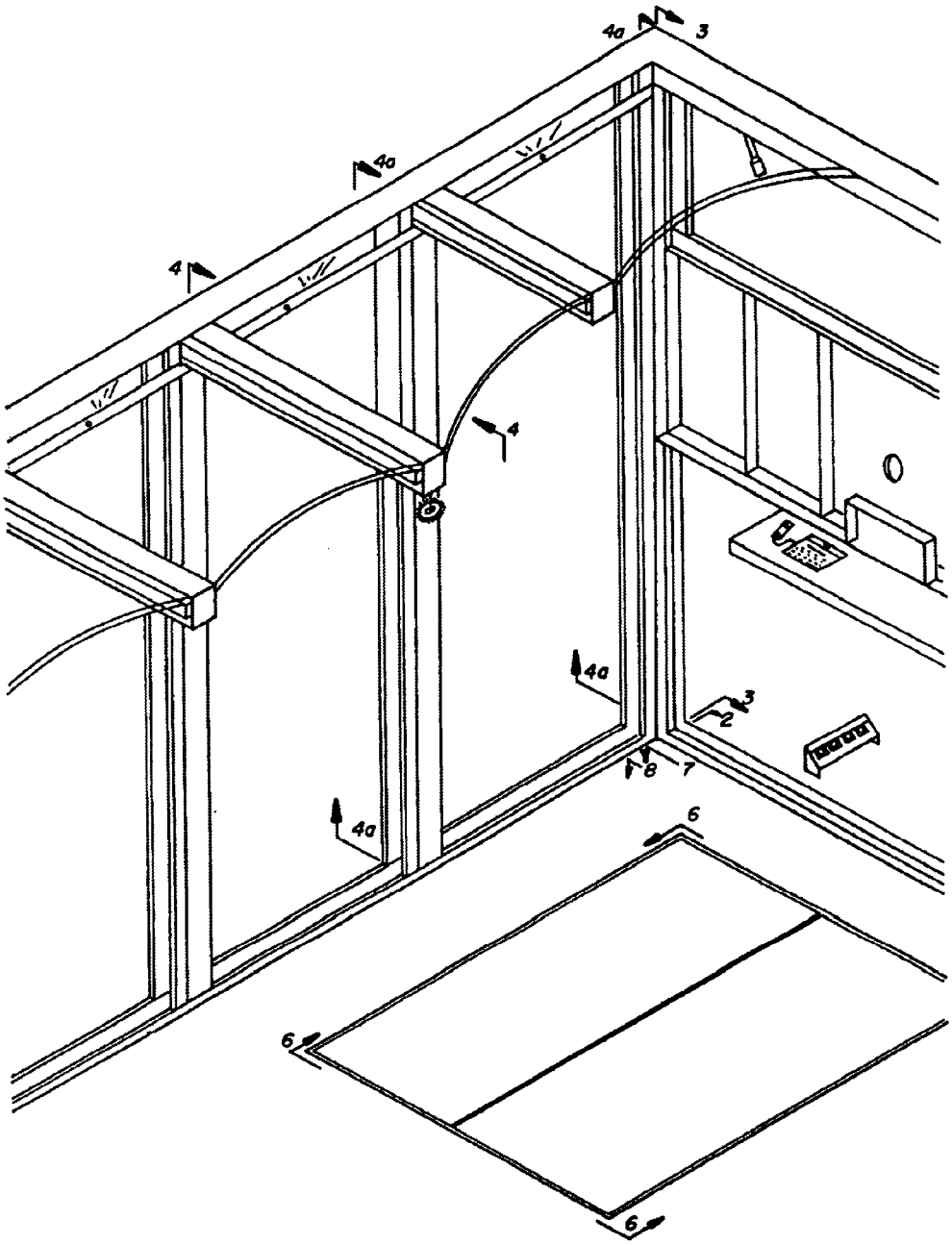
FIG. 1B is a parallel view of inside illustration of security chamber and teller window.
Figure 1C:
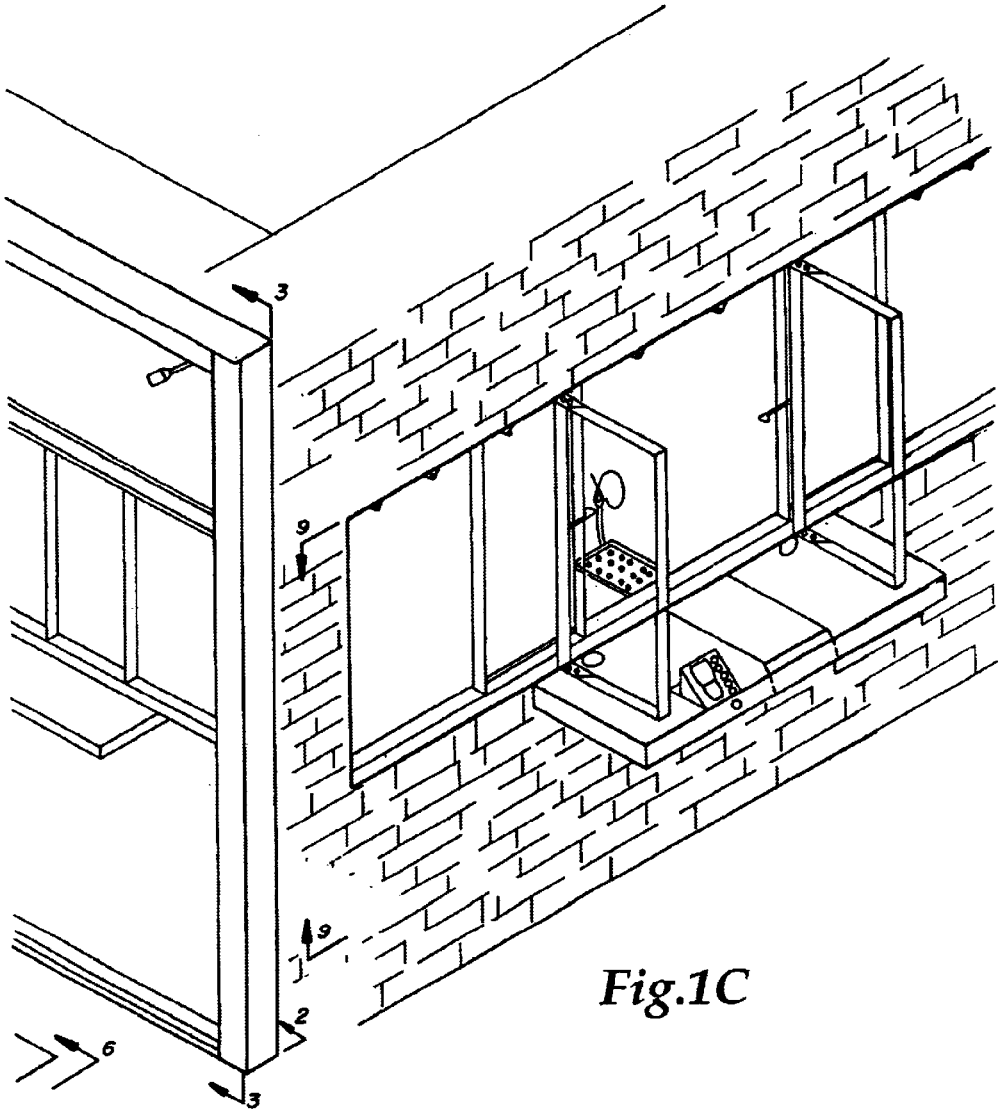
FIG. 1C is a longitude outside schematic view of drive-in/drive-through teller window.

FIG. 1A, FIG. 1B and FIG. 1C provides overview of elements of security systems structure 5 in accordance 6 comprises a steel drop door to a secured containment room for apprehension of bank robber from within lobby. While 3 comprises controlled teller/customer verbal and financial transaction areas for maximum protection, and FIG. 1C shows side exterior similar arrangements.

Figure 2:
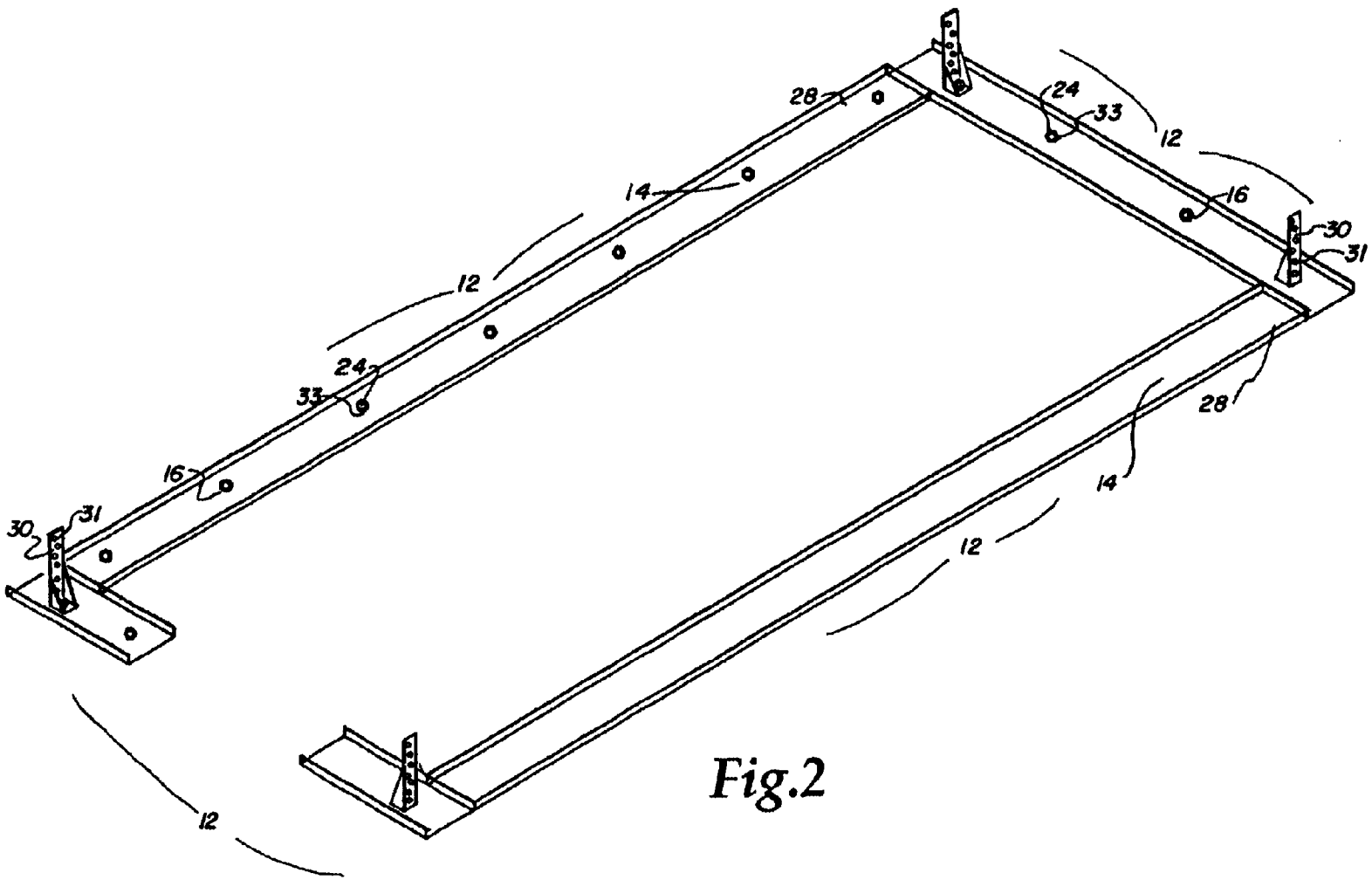
FIG. 2 is a diagrammatic view of layout perimeter of security chamber.

FIG. 2 Detailed elements provides the layout perimeter of 12 "Lobby Banking Financial Security Chamber," as 7'×16' OD and establish 14 anchor location line of 1¾" inside first line all the way around. Establish 16 anchor locations from intersecting corner lines for teller end wall. Now, measure on a horizontal plane, inward from both ends 5¾" and 24" on center for a total of 4 anchor locations. For entrance sliding doors to Lobby Banking Financial Security Transaction Chambers; measure on a horizontal plane, inward from both ends 5¾" and 14¼" on center for total of 4 anchor locations. Now, for wall construction, measure on a vertical plane, inward from both ends 6¾" and 25" on center for a total of 7 anchor locations. Both walls are with identical measurement and locations.

Figure 2A:
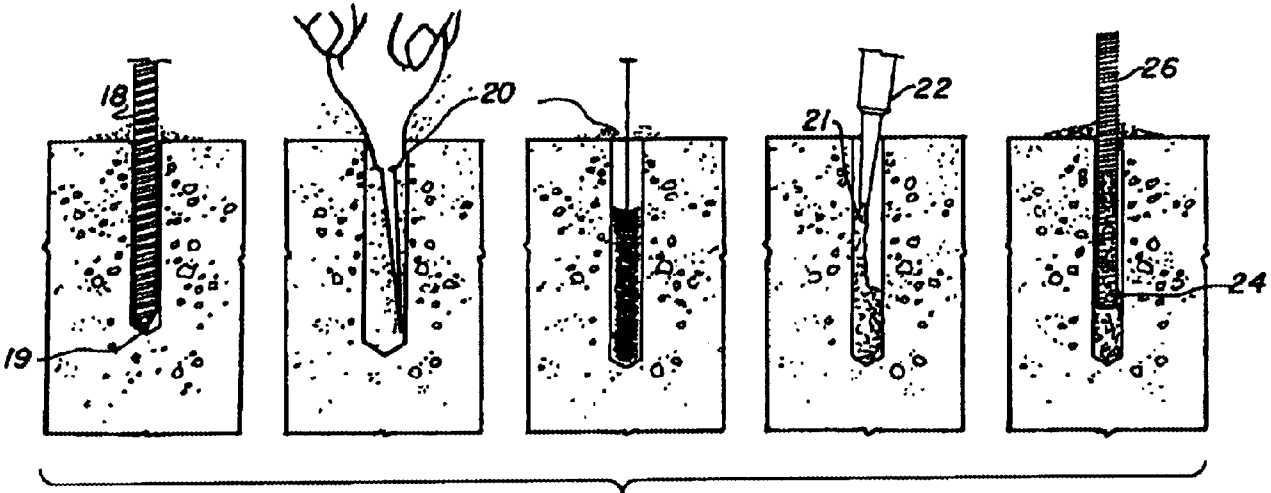
FIG. 2A is a perspective view of anchor choices illustrating the mounting of assembly.

FIG. 2*a* Using 18, 1" conventional drill bit; drill 19 hole depth of 7½" deep, clear all debris from holes with 20 manual or conventional air compressor.

Now we are going to use 21 ET-22 Epoxy-tie resin, and place in each hole, one at a time, fill half full from bottom up and to avoid air bubbles, slowly withdraw 22 mixing nozzle as hole is being filled. 24 insert ⅞" 11 UNC 2A×8½" anchor threaded stud flat, and turning slowly until seated. 24 anchor threaded stud flat will have a 26 1" above grade check for plumb. Set time is 6 hours and cure time is 24 hours. It is noted here that Epoxies offer stronger bonding, shorter cure time, and less hydrolization that other types of resin anchors. ET-22 Epoxy-tie is a two-component amine-based system for high strength bonding.

Locate on all 28 bottom plate track, corresponding 16 anchor locations and pre-drill with 18 1" conventional drill bit. Apply polyurethane sill sealer to all edges of bottom track webs and install over 24 anchor threaded stud flat, ⅞" UNC 2A×8½." It is noted here that the anchor stud and installations used in this design is for an existing floor. A powder driven anchor provides another option, such as, ½" ×10" A.B. 6'–0" O/C (TYP. UN.0.) 9" from ends. Minimum 2 per track section. There are several anchor choices available for new single or double pour floors; for single pour S/PAHD42, S/MPAHD, S/HPAHD22, HPAHD22-2 holddowns, and for double pour, typical HPAHD22-2P or typical S/HPAHD.

Teller wall has a horizontal length of 7' with 4 anchor locations, entrance wall will be a 2' 28 bottom track length on each side of the wall and with two anchor locations on each side. Vertical bottom track wall length is 15'5", I.D. (inside diameter). Vertical 28 bottom plate track has 7 anchor locations, and with other side being identical. Both vertical 28 bottom plate tracks will butt both horizontal 28 bottom plate tracks.

Figure 2B:
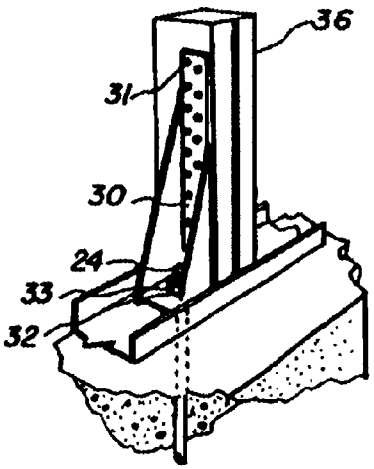
FIG. 2B is a sectional view of gauge steel hold-downs to stabilize structure.

FIG. 2*b* Install 30 S/HD 8–10 gauge steel holddowns, ¼" plate at all corners to stabilize structure. Secure to corners with 24 #10 screws. To anchor, secure all anchors with 32 heavy locking washer 15/16" steel and 33 hex nut ⅞" UNC 2B steel. Total number of 16 anchor locations is 22.

Figure 3:
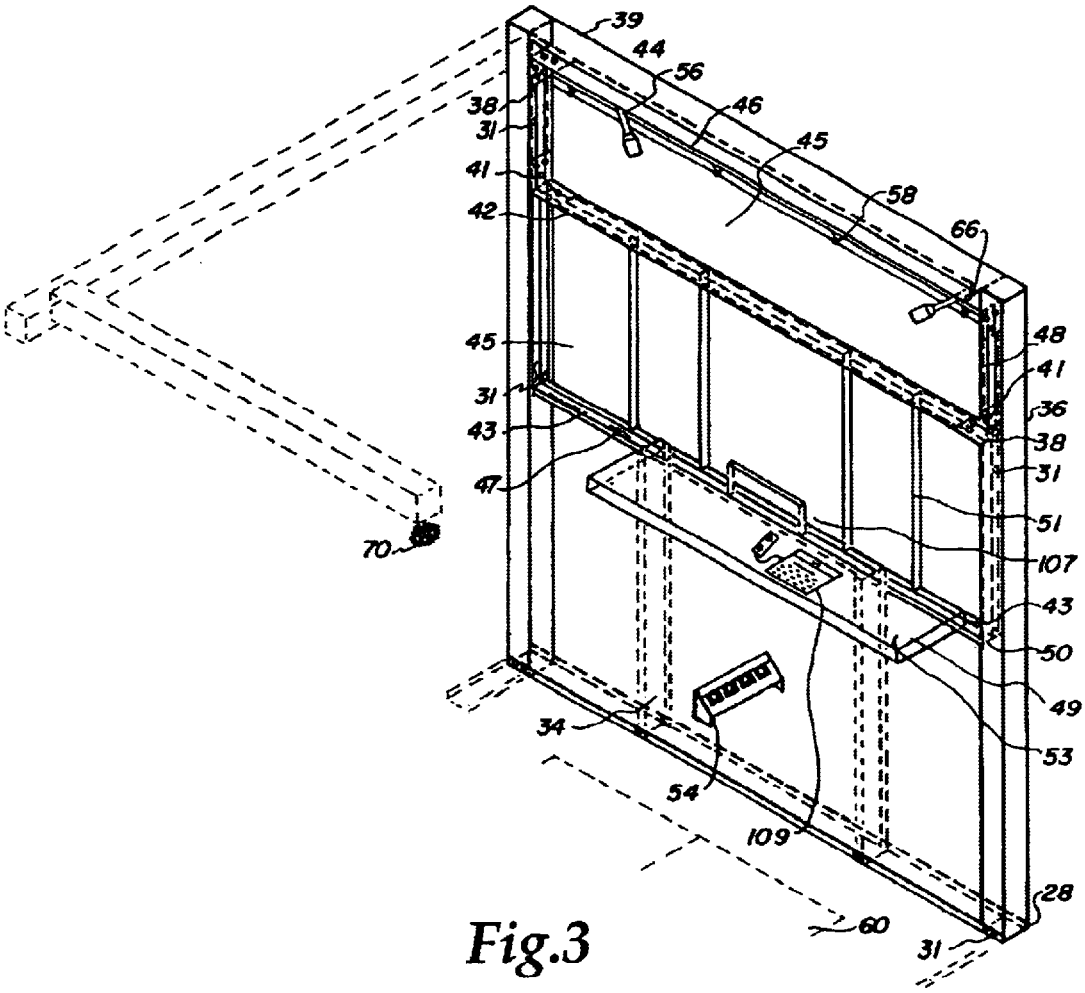
FIG. 3 is a diagrammatic inside view of teller transaction window.

FIG. 3 Provides detailed elements of teller transaction window wall within the Lobby Banking Financial Security Chamber. To make double studs interconnect 34 two (2) single studs of 3½" ×8' 20 gauge steel fastened together through flanges with 37 ¾ #8 teks low profile pan head screws pan head screws through flanges on both sides of studs.

Now, install vertical 36 double stud assembly to 28 bottom plate track 3½ 20 gauge steel to each end, and secure with 31 ¾" #10 teks low profile pan head screw through each flange. There are four (4) flanges here. From top of inside face of 36 double studs, measure down 3½" of each assembly of each side. Fasten to 36 double studs 38 bent plate angle steel 3"×3"×3"×¼" (each side is 3" tall and 3" long by ¼" thick), using 31 ¾" #10 teks low profile pan head screws, and each side of angle will require three (3) of these pan head screws. Take 39 horizontal beam double stud which is 6'5" and place on 38 bent plate angle 20 gauge steel 3"×3"×3"×¼". Fasten angle to beam from bottom side with 31. There are three (3) screws required for each side.

Install 6'5" length of 48 1¼" window casing steel to underside and outside edge of 39 horizontal beam, fasten with 66 1¾" #10 teks low profile pan head screws. Measure inward from each end 2½". Now, measure and place screws every 24" apart. There are four (4) screws required for these. From 39 horizontal beam 36 double stud intersection, install vertical length of 48 1¼" window casing steel on each side of 18½" in length, use 66 1¾" #10 teks low profile pan head screws. Measure 7" apart and fasten to studs on both side, three (3) on each side. To 36 install 38 bent plate angle 3"×3"×3"×¼" 20 gauge steel with one on each side. Fasten this with 31 ¾" #10 teks low profile pan head screws, and put three (3) screws to each side of angle. Fasten 42 3"×¼" plain plate 20 gauge steel with horizontal measurement of 6'5" and fasten with 41 ½" #8 teks low profile pan head screws. To bottom of 42, install 43 a 2" double window track 20 gauge steel to bottom of 42 3"×¼" plain plate 20 gauge steel, and fasten with 41 ½" #8 teks low profile pan head screws. Measure every 24" and secure pan head screws. Now, continue with 43 2" double window track 20 gauge steel, install in a downward, vertical length with a measurement of 2'8" for both sides, and fasten with 41 ½" #8 teks low profile pan head screws, measure every 24" and secure screws.

Install 38 bent plate angle 3"×3"×3"×¼" steel 20 gauge to 36 double studs with 31 ¾" #10 teks low profile pan head screws and continue in horizontal measurement of 6"540 to 43 2" double window track 20 gauge steel; leave a 2" space for 49 2" granite counter top and at 2'10", install 50 3" clip to 36 double studs, on each side with 31 ¾" #10 teks low profile pan head screws and fasten 44 top plate track; 3½"×6'5" 20 gauge steel and 28 bottom plate track 3½"×7' 20 gauge steel, fasten with 31 ¾" #10 teks low profile pan head screws, using one pan head screw on each flange.

Now, returning to top of wall, install into the 6'56"×21" opening from the back side 45 1" Bullet and Bomb Resistant Paltech Advanced Polymers Plastic; mirrored on outer side, 6'5"×1"×21" and attach 46 ¼" vinyl wedge gasket using a caulking gun with 47 silicon sealer (conventional), spread on both sides and entire length of 46 ¼" vinyl wedge gasket, then secure to the 6'5"×1"×21" Paltech panel. Install 48 1¼" window casing 6'5" to underside of outside edge of 39 horizontal beam with 66 1¾" #10 teks low profile pan head screws. Measure 2½" inward from each end. Remaining screws are 24" apart on bottom window casing as this is identical. Vertical side pieces are 18½" long. Measure 1¼" inward from each end and remaining screws are 8" apart.

Now, element 51 install sliding window panels 2'8"×1"×1' with 45 1" Bullet and Bomb Resistant Paltech Advanced Polymers Plastic; mirrored on outside, install in back track of 43 2' double window track 20 gauge steel. These panels are pre-framed from manufacture. This creates 2'8"×1"×1' teller transaction window in front track of 43 2" double window track 20 gauge steel. Install 2'8'×1"×6'5" 45 Paltech panel with 46 ¼" vinyl wedge gasket all around. Using caulking gun with spreading 47 silicon sealer (conventional) all around. Install 48 1¼" window casing all around and attach to 36 double studs with 31 1¾" #10 teks low profile pan head screws, and measure horizontal 6'5" and 12" on center, then measure vertical 2'8" and 8" on center. Back of wall is identical. 45 Paltech panel has a 4" circumference cut for teller communication.

Figure 5B:
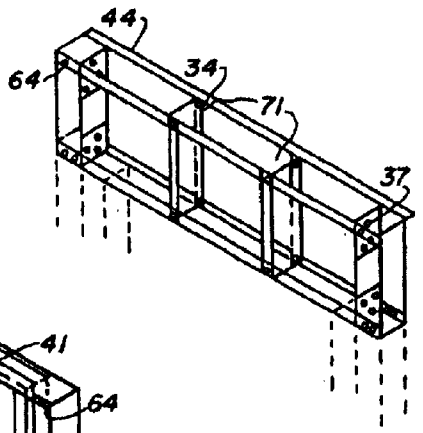
FIG. 5B is a diagrammatic view of entrance door sliding tracks.
Figure 6A:
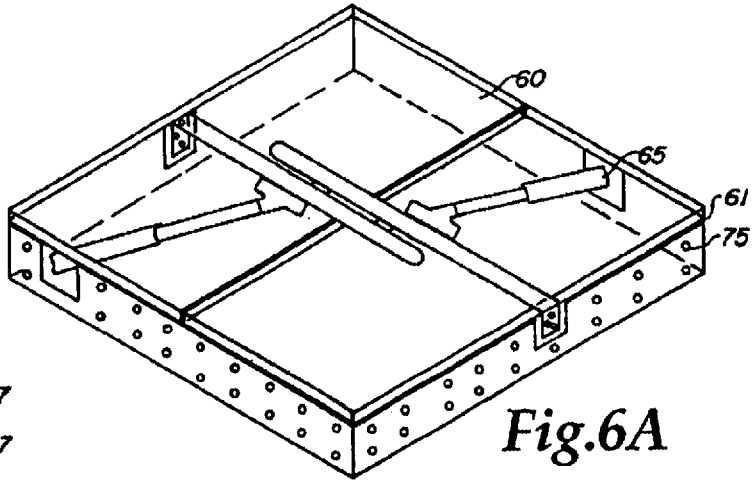
FIG. 6A is a plan view of hydraulic scissors type supporting component parts for steel drop doors.

Element 53, measure 43" from teller counter top to floor, install 6'5"×2"×1"×43" sheet of synthetic marble covering front and back of teller wall. 60 measure directly centered in front of teller window located on floor is 2"×4"×5' steel drop door. Additional embodiments are shown in FIG. 5*b*, FIG. 6 and FIG. 6*a*.

Figures 9, 9A:
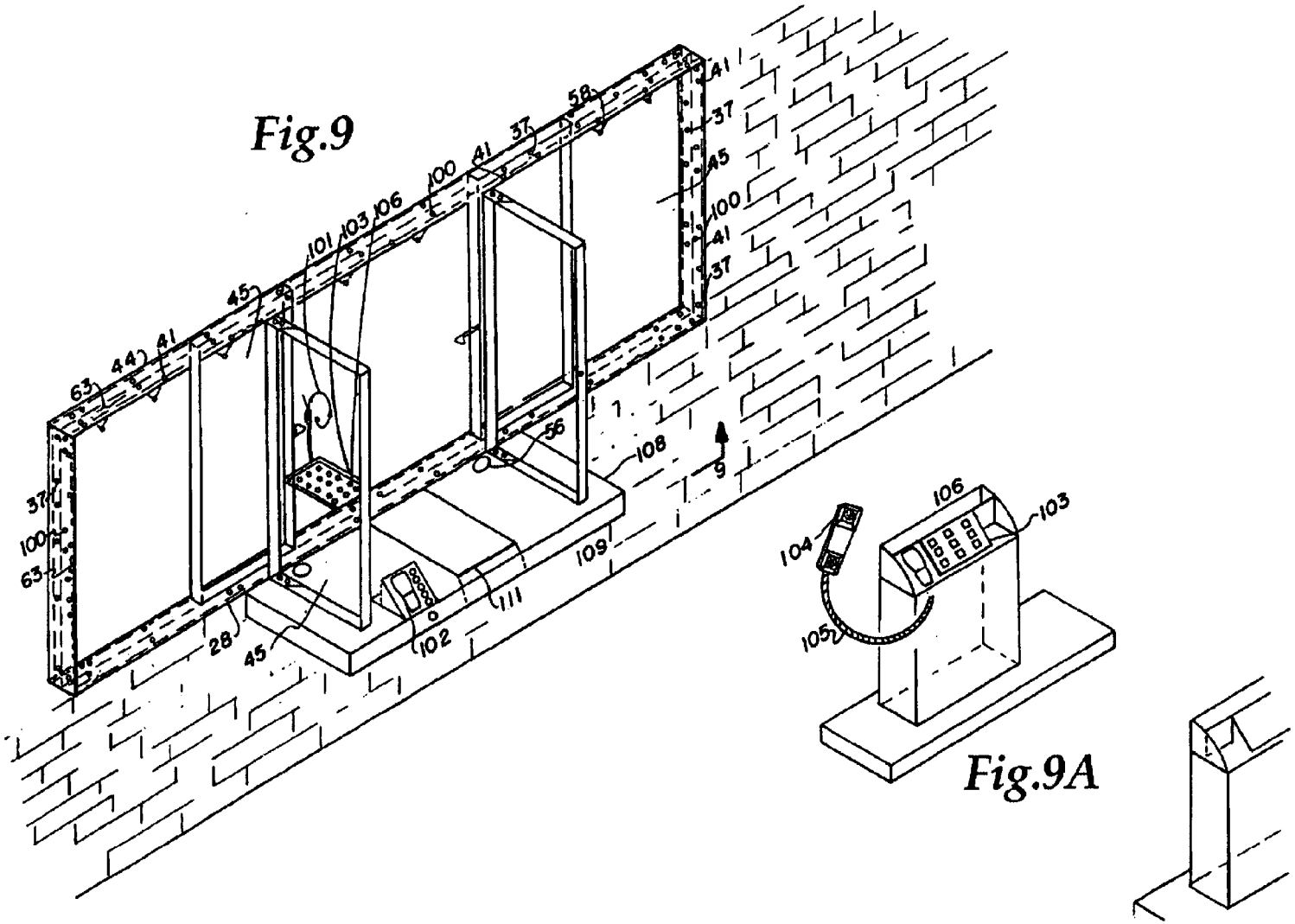
FIG. 9 is a side perspective view of the bank teller window.
FIG. 9A is a clear perspective view of drive-through communication module.

54 Electrical Master Control Console 20"×3"×5" is located behind teller wall underneath teller transaction counter top and is floor mounted at a 45 degree angle. The 54 Electrical Master Control Console is also within an extended distance where the bank teller will be able to extend leg to reach 54 push button switches with foot, while standing or in a sitting position. Additional embodiments are shown in FIGS. 4, 5, 5*a*, 5*b*, 6, and 7; as each push button controls 68 Leaner Track Lighting System, 70 Fire Sprinkler, 58 Security Camera Lens Track System, 74 Entrance Doors with Locks, 51 Teller Sliding Windows with Locks, 56 Pepper Gas Spray Heads, 60 Steel Drop Doors with Locks, and 55 Alarm System. These systems can be activated independently of each or together simultaneously. Element 111 is also shown in FIG. 5*b* and FIG. 9.

Figure 4A:
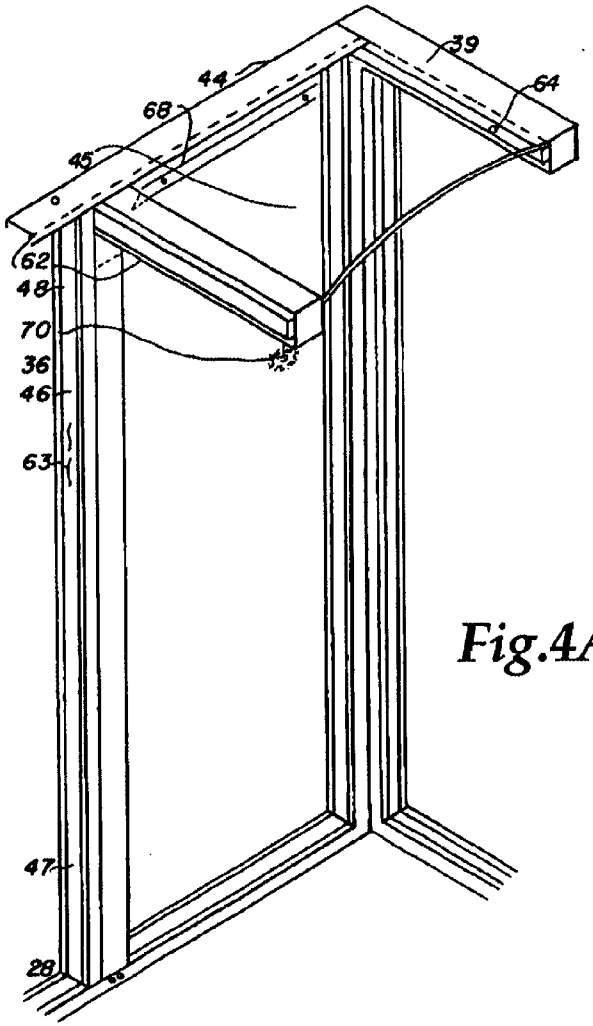
FIG. 4A is a sectional view of window casing.
Figure 4:
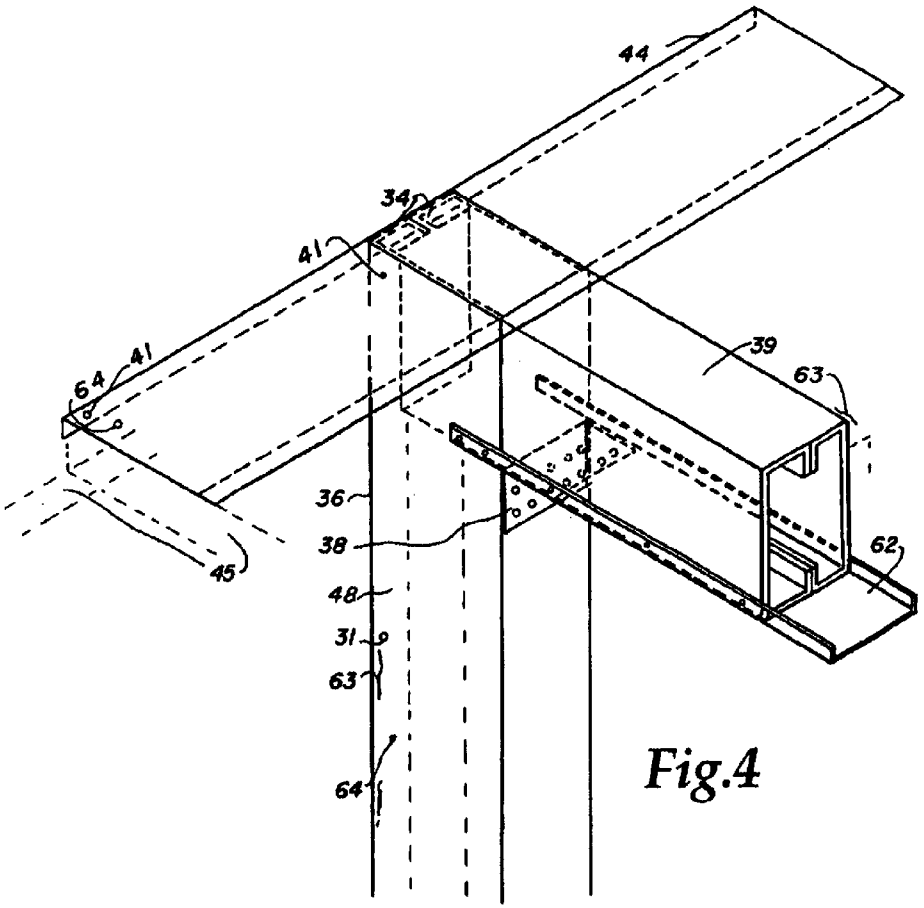
FIG. 4 is a partial sectional view of double stud beam assembly.

FIG. 4 Describes detailed elements of Interlocking 36 Double Stud 39 Horizontal Beam Assembly of Lobby Banking Financial Security Chamber walls which measured 15'5" in length. Fasten this to 28 bottom plate track through flange using 41 ½#8 screws and put 2 screws on each side of 36 double studs. Now, fasten previously installed 30 S/HD holddown with 31 ¾" #10 screws, with already pre-drilled holes and 24 screws are required. 109 TDDY System is counter mounted for hearing impaired.

Fasten together two (2) 24 single stud, using ½" #8 screws, and measure every 24" apart through flanges for each screw, 8 screws are required to make a 36 double stud assembly. Measure 3½" from end of stud, prior to fastening together. Cope flange and bend outward. Cut and discard web; this is done to each single stud, one end and one side. Fasten studs together with 41 ½" #8 screws, place one screw every measured 24" through flanges on both side. 39 horizontal beam, when erected will be threaded into 36 double studs and fastened; creating an interlocking 36 double stud 39 horizontal beam connection and providing maximum strength for the stud and beam structure.

To previously installed 28 bottom plate track, a length of 15'5", measure and mark all 36 double stud location of 37" apart for a total number of 5 sets of 36 double studs. Erect each set and center 36 double studs in track on location marks. Fasten these to 28 bottom plate track using 31 ¾" #10 screws, and put one screw through each flange on each side. Both walls are identical. Install all 36 double studs at this time.

Raise and install 39 horizontal beams 6'11" in length as follows: raise 39 horizontal beam, thread into coped 36 double stud, fasten through bend out flanges to 39 horizontal beam Use 31 ¾" #10 screws, measuring 1½" apart vertically and horizontally. Put 6 screws on each side of 36 double studs for connection. To underside of 39 horizontal beam and 36 double stud intersection, fasten 38 bent plate angle, using 31 ¾" #10 screws and 4 screws to each side of angle; eight (8)screws are required on the already pre-drilled bent plate. Now to bottom of 39 horizontal beam, raise 62 head track of 6'8½" in length flange turned up and secure to bottom of 39 horizontal beam through 62 head track web and flanges on both sides. Now, measure inward 2½" from edge of 62 head track web end, and 1" inward from outside web edge for first row of screws. There are 2 rows and remaining screw locations are 35" apart for each row. Flange screws correspond to horizontal web screw locations. With vertical spacing of ½" from top edge of flange. Use 31 ¾" #10 screws and ten (10) screws are required.

Element installation of 44 top plate track. The 44 top plate track is 15'5" in length, with a manufactured coped-straight out flange on one side. Now, erect and set in place over tops of 36 double studs and connect from end to end. Turn coped flange to inside and fasten outside track flange to outside face of 36 double studs, with one on each side. Use ¾" #10 screws, putting two screws of equal distance apart on each stud. A total of 10 screws are required.

FIG. 4*a* To inside web of 44 top plate tract, install 40 1"×2" window casing 34" long, butt to flange. Secure casing by fastening through 44 tops plate track down through casing, using 41 ½" #8 screws, measuring 10⁵⁄₁₆" apart; three (3) screws are required for this. To 28 bottom plate track install 40 1"×2" window casing 34" long butt to flange, secure down through casing to track with 64 1¾" #8 screws, measured 10⁵⁄₁₆" apart. Three (3) screws are required. Butt to bottom and top 40 1"×2" window casing, of 7'11⅞" on side section. Fasten through casing to 36 double studs and using 64 1¾" #8 screws, measure 2½" inward from each end. Installation of remaining screws are 18" apart and 7 screws are required on each side.

We are now going to backside of 40 1"×2" window casing and apply 63 conventional Epoxy sealer. Insert manufactured cut-to-fit panel of 45 1" Paltech plastic panel 34" wide×1" thick×7'11¾" long with 46 ¼" vinyl wedge gasket. To 28 bottom plate track, install 40 1"×2" window casing 34" long. Butt to flange and secure down through casing to track with 64 1¾" #8 screws, measuring 10⁵⁄₁₆" apart. Three (3) screws are required. Butt to bottom 40 1"×2" window casing, 7'11⅞" for inside section. Now, fasten through casing to 36 double studs with 64 1¾" #8 screws, measured 2½" from end edge distance of each end. Remaining screws are 18" apart, and 7 screws are required on each side. Lets install 46 1¼" vinyl wedge gasket with 47 silicon sealer. There are five (5) panels per wall length.

Elements of ceiling installations are as follows: measure down from top edge of previously installed 39 horizontal beam 1" on both ends, mark and strike a line end to end. Install 6'8½" length of 40 1"×2" window casing. Use 66 1¾" #10 screws. Measure 2½" inward from end edge remaining screws are 16" apart and 5 screws are required. Now, fasten through 48 1¼" window casing to 39 horizontal beam and fasten through casing to both beam. Apply 63 epoxy sealer to top side of 40 1"×2" window casing, and each end of manufactured pre-cut 45 1" Paltech Panel of 34" wide×1" thick×6'8½" long. 45 1" Paltech Panel will be maneuvered up through span between 39 horizontal beams and threaded into position, end edges of 45 1" Paltech Panel butt to side window panel and rest on horizontal 40 1"×2" window casing length. Weight of ceiling panel and 63 epoxy sealer provides an air tight seal, fully supported ceiling and wall Paltech connection. Both walls of structure are identical with this installation. All ceiling installation are also identical.

Elements of 68 track lighting, halogen system, will be installed inside chamber, 7'8½" top parameter of chamber structure, 6'5" wide, 15'5" length. A conventional 70 fire sprinkler head is located on 39 horizontal beam, measuring 3'2½" on center. This sprinkler system is interconnected with already existing banking sprinkler system.

Figure 5:
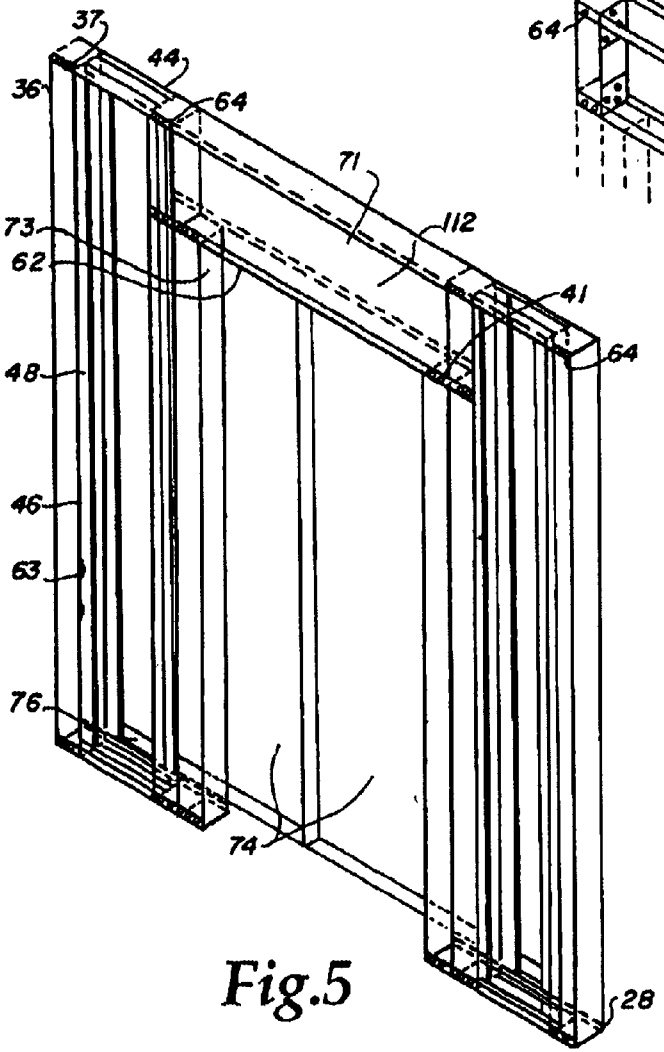
FIG. 5 is a diagrammatic view of entrance wall configuration.

FIG. 5 Provides-detailed elements of Entrance Wall Configuration. This entrance is 7' in width, center is 3'6", to each side of center, measure 18." This measurement combined equals 36", which is the width of the 74 entrance doors and the 73 doorjamb location begins on these measurements. We are going to erect and install 36 double studs 6'9" in length. To previously installed 28 bottom plate track, using 37 ¾" #8 screws, fasten through track flange 2 screws are on each side. Four (4) screws are required. Identical installation is for other side.

Now, we going to install a second set of 36 double studs 8' in length. To 28 bottom plate track using 37 ¾" #8 screws and fasten through track flange, two (2) screws on each side. Four (4) screws are required. These studs are erected and standing side by side. The other side is identical. This installation will provide maximum load bearing support for 74 entrance doors and 71 door header.

Lets measure a distance of 14" and install corner 36 double stud assembly 8' in height and both ends of entrance are the same. We are going to erect 36 double studs and fasten to 28 bottom plate track through flanges. Using 37 ¾ #8 screws, two (2) screws on each side, equal distance apart, for a total of 8 screws. Secure previously install 30 S/HD holddown to 36 double studs with 31 ¾" #10 screws, 24 screws are needed for each installation for each end of wall.

Now, we must connect to both previously erected 36 double stud assemblies 6'9", a horizontal length of 62 head track a length of 3'7". Cope web on both ends of 3½" of 62 head track flange pointing them up, bend web in an upward direction. Secure coped web to 36 double studs, and both ends. Use 41 ½" #8 screws, two (2) on each side and each end; measured 1" apart. Secure coped cut flanges to 36 double studs, use 41 ½" #8 screws, two screws (2) for each flange, measured 1" apart. There are eight (8) screws required.

To 62 head track install in a vertical direction, two (2) 72 cripple studs 10" in length, with flanges turned facing each other, secure to 36 double studs on each side and fasten flange through flange with 41 ½" #8 screws, 1 screw each top and bottom flange on each side. Four screws are required.

To vertical 72 cripple studs install 44 top plate track, 3'7" in length. Again, cope both ends 3½" inward on each end and bend downward on both ends. Erect and install over cripple studs, flange turned down. Secure coped web to sides of 36 double studs using two (2) 64 1¾" #8 screws, measured 1½" apart, using 2 screws for each web and each end. There are four (4) screws are required.

We are now going to secure coped flanges to sides of 36 double studs and both sides using 64 1¾" #8 screws, measured 1" apart; two (2) screws for each flange and for each side. Fasten to 72 cripple studs, with 31 ¾" #10 screws, flange through flange, put screws in center where the flanges connect. There are two (2) screws to each side. A total of four (4) screws are required for top and bottom on both sides. Now, install 112 over face of door header, secure with ½" #8 pan head screws, 3½" inward from each end, space screws every 18". Three screws are required at top and bottom sides. Both sides are identical.

Figure 5A:
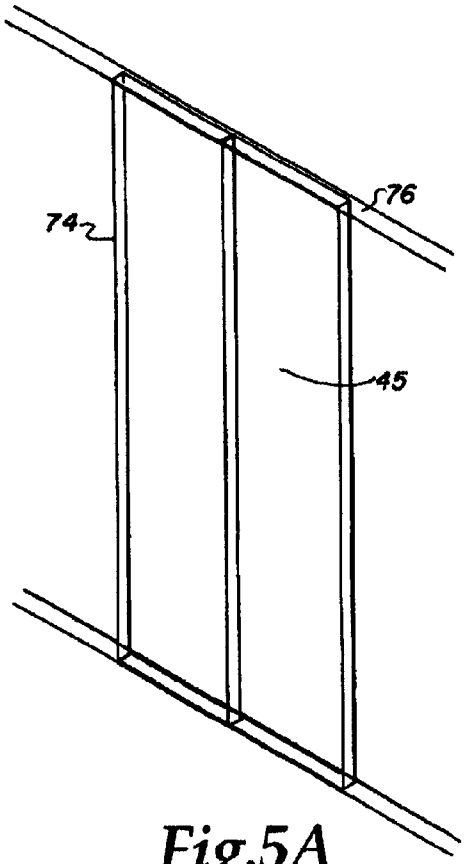
FIG. 5A is a partial view of entrance way door headers.

FIG. 5*a* Provides described elements for installation of 71 Door Header, as follows: cut two lengths of 34 stud, 3'7" in length. Cope each end of each 34 stud, 3'½", cut off and discard flange pieces from each end. There will be a 3'½" web extension on each end, with each length being turned on its flange side and aligned with 44 top plate track edge. Flanges are facing inward. Each side is identical. Thiscreates the 71 Door Header. Secure this in place to 44 top plate track with 64 1¾" #8 screws. Now, screw these through 44 top plate track web, and up through flanges of 71 Door Header, measuring on each side is 12" apart to put screws. Other side is identical. To top of this entire wall assembly, raise and install over tops of all 36 double studs, 44 top plate track. This track is manufactured coped on one side. Install this coped flange toward inside of chamber, flange will overlap at wall 44 top plate track intersection. Fasten, 44 top plate track to 36 double studs and down through overlapping, 44 top plate track, with 37¾" #8 screws. Measure 1" apart, put screws through flange and web to studs, and measure 1" apart on over lapped track, put screws through track connection. A total of twelve (12) screws are required.

Now, standing inside of Lobby Banking Financial Security Chamber, look out through 14" opening and install 48 1¼" window casing; with a measurement of 14" in length, butt to outer flange 44 top plate track. Secure 48 1¼" window casing by screwing down through web of 44 top plate track into 48 1¼" window casing. Use 37 ¾" #8 screws, measure 6" each way from center on window casing; with a measurement of 14" in length, butt to outer flange 44 top plate track. Secure 38 1¼" window casing by screwing down through web of 44 top plate track into 48 1¼" window casing. Use 37 ¾" #8 screws, measure 6" each way from center on window casing, two (2) screws are required; to 28 bottom plate track. Butt 48 1¼" window casing to outer flange and secure through casing to 28 bottom plate track using 64 1¾" #8 screws, measure 6" each way on center of casing, put two (2) screws on each side. Total of two (2) screws are required. Install side pieces of 48 1¼" window casing 6'5½" in length. Butt between top and bottom casing, apply 63 epoxy sealer to front side and secure to 36 double studs on each side. Fasten 64 1¾" #8 screws, measure 16" both ways from center. Four (4) screws are required to fasten. Install 14"×1"×6' 8½" 45 Paltech panel. Insert 46 ¼" vinyl wedge gasket, and install to 44 top plate track and 28 bottom plate track 14" in length of 48 window casing. Fasten down through 44 top plate track with 37 ¾" #8 screws, measure from center 6" each way, and two (2) screws are required. Coat side that touches panel with 63 epoxy sealer and install 46 ¼ vinyl wedge gasket between panel and 48 1¼" window casing edge. To 28 bottom plate track install 14" length 48 1¼" window casing and coat side that touches panel with 63 epoxy sealer. Fasten using 66 1¾" #10 screws, and measure 6" both ways from center. Two (2) screws are required.

Insert 46 ¼" vinyl wedge gasket between panel and 48 1¼" window casing edge. Between top and bottom horizontal 48 1¼" window casing install a measured 6'5½" vertical 48 1¼" window casing, after coating sides that touch 45 1" Paltech panel with 63 epoxy sealer, fasten to 36 double studs with 66 1¾" #10 screws, and measure 16" from both ways from the center. Fasten with a total of 4 screws. Insert 46 ¼" vinyl gasket. Other side is identical.

Having addressed the structural elements/components and inter-connections of FIG. 5 and FIG. 5*a*. I now focus on FIG. 5B, 74 entrance doors.

FIG. 5B Describes elements of 74 entrance doors. These doors are installed in a set back sliding track, top and bottom. This horizontal track is set flush to inside edges of 73 door jamb. 74 entrance doors consist of two equals panels which are measured 18"×1"×6'9" when closed they are 36"×6'9". These panels are manufactured pre-framed and adaptable to conventional sliding track. These doors are constructed polymers of 45 1" Paltech high-impact resistant advanced polymers, which is a combined strength of polycarbonate and security film, laminated in layers. This provides a level-4 bullet and bomb resistance; is mirrored on outside, providing complete confidentiality and security for all transactions.

Having completed 12, 111 Height Measurement Strip is adhesively secured on inside frame of entrance doors of Lobby Banking Security Chambers and the frames closest to lobby banking transaction teller. These 111 Height Measurement Strips are complimentary blended colors to total interior decor.

FIG. 6 Provides detailed elements of Containment Room. For this configuration, we must start from teller wall base of inside Lobby Banking Financial Security Chamber Teller Wall. Locate, by measuring for center of teller chamber wall. Teller wall base is 38 ½" from top counter to floor, measure 2' on each side of center line (mark these locations). Now, measure in a vertical direction, toward inside of chamber for 1' and mark this on both previously location 2' measurement lines. We are going to continue on these lines, and measure 5'. Connect these lines in a horizontal direction. The end result is a 4'×5' rectangle. Measuring 1' from bottom of teller wall, this rectangle configuration will be cut out all the way through to the basement. Clean all debris.

FIG. 6*a* Having completed all of the above, we are now going to install 60 Steel Drop Door. Desired carpet, complimenting bank decor, will be measured and cut to fit steel drop door panels. This pre-cut measured carpet panels will then be adhesively secured to steel drop door panels prior to steel drop door installation. This steel drop door is manufactured pre-framed and consist of (2) 2'×5' with removable pre-hinged panels, hinges are to the underneath sides. Frame is pre-drilled for required concrete fasteners, which are necessary to secure frame in place. For 5' side, measure 1" indention on both ends, with remaining holes measured 14½" apart, and both sides are identical, 75 powder driven fasteners; eight (8) are required for each side. For 4' frame sides, there will be a 1" indention on both ends. Remaining holes are measured to be 11½" apart, and both sides are identical, eight (8) 75 powder driven fasteners are required. Understanding variables of floor thickness; it is best to use two (2) rows of fasteners on all sections of frame for this application. The floor is 6" thick, rows will be measured 2" inward from top and bottom of outside edge for all sides. Now, apply 63 epoxy sealer and 61 ½" rubber gasket to all sides of frame, prior to installation of fasteners. These doors are electronically operated with electronic controlled instant self locking, 65 hydraulic scissors type hinges are installed from underneath and two (2) sets are on each side; located 1'6" to the inside of 5' panels. Remaining desired carpet shall be adhesivley secured to entire floor of Lobby Banking Financial Security Chamber after completion of chamber.

We are now in the basement; and standing looking up at the opening for 60 steel drop door of 4'×5', measure 6" to both sides of 4' dimension strike line, creating a 5' square on ceiling. Now, transfer this exact measurement to floor directly below for FIG. 6 containment room dimensions which are 5'×5'×6' in this application. We have now constructed the perimeter top and bottom of FIG. 6 containment room. It is noted, basement height may vary according to an existing banking facility structure.

Install to ceiling, on both horizontal lines, one (1) section of 44 top plate track 5' in length, pre-cope flange on each end, and on one side only, measure 3½" bend flange where it is level with 44 top plate track web. Pre-drill track to accept fasteners. Locate center of web at 1¾" strike a line, end to end and-along this line, measure inward 2" from each end mark. Remaining hole locations are 14½" apart. Install 44 top plate track flange side painting toward floor and coped end turned toward floor and coped end turned toward center of FIG. 6 containment room. Fasten with 75 powder driver fasteners. Four (4) fasteners are required for this.

Now, install two (2) vertical lengths of 44 top plate track 5'7" to already installed 5" lengths. Pre-cope flange on each end and one side only, 3½" bend flange where it is level with 44 top plate track web. Pre-drill track to accept fasteners. Locate center of web, measure 1¾", strike a line end to end. Along this line, measure inward 3" from each end and mark. Remaining holes locations are 14½" apart. Install these 44 top plate tracks with flange side pointing to floor and coped end turned toward center of FIG. 6 containment room. Insert coped ends of vertical 44 top plate track into previously installed horizontal 44 top plate track coped ends. These coped ends will lay inside and on 44 top of one another. Secure and fasten with powder driven fasteners.

Element 28 bottom plate track installation for FIG. 6 containment room is mirror image of 44 top plate track installation; with one exception being, on in one vertical 5'7" wall length, this 28 bottom plate track will be in two (2) sections, and each being 17½". 3½" is to be inserted into horizontal 28 bottom plate track coped end, leaving a wall length of 14" and both ends of wall are the same. Measure 3" inward from coped intersections; secure with fasteners and measure 1" inward from opposite end of 14" section. This provides a 32" opening for 82 steel door installation. It should be noted to face all coped flanges toward inside of room.

Elements to all corners, where 44 top plate track and 28 bottom plate track mate. Install 36 double studs measured 6' in length. Fasten through flange into 36 double studs with 37 ¾" #8 screws, two (2) screws are required and measurement are equal distance apart. Install these fasteners on all locations where 36 double studs connects with flanges. Thirty-two (32) fasteners are required. Now, install 36 double studs to ends of 14" vertical wall lengths. Fasten using 37 ¾" #8 screws, measuring equal distance apart, eight (8) screws per double stud installation for top and bottom.

Once again, we are standing inside FIG. 6 containment room, looking out through wall opening. We will now install to all 36 double studs and between 44 top plate track and 28 bottom plate track 79 L2"×2"×¼"×5'11½" angles, secure to 44 top plate track and 28 bottom plate track, through flanges with 41 ½" #8 screws and two (2) screws are required. Fasten to 36 double studs 79 L2"×2"×2"×¼" with 4'×11½" 41 ½" #8 screws. Measure inward from each end 1¾" and remaining screws are 17" apart. There are five (5) screws are required for this.

Now, apply 78 industrial adhesive to 44 top plate track and 38 bottom plate track flanges and to 79 L2" angles. Place 45 1" Paltech Panels of 4'11½"×1×5'11½" inside wall openings. Press in place to flanges and 79 L2" angles. Secure in place with 80 L1" angle to flanges. Measure inward from each end 1¾". Then measure 28" each way toward center. Use three (3) 79 L2"×2"×¼"×2" and three (3) are required. Fit 80 L1" angles tight against panels and fasten to 44 top plate track and 28 bottom plate track webs with 41 ½" #8 screws. There are two (2) screws to one leg of each angle. Twelve (12) screws are required for top and bottom. Two (2) sides, which are 5'11½" long, fasten to 36 double stud with 80 L1"×2"×¼"×2". Measure 2½" inward from each side and remaining locations are 22" apart. Again, fit four (4) 80 L1"0 tight against panels. Use 31 ¾" #10 screws and put two (2) screws to one leg of each angle. A total of eight (8) screws are required to both sides.

The 14"×1"×15'×11½" panel installation is identical with exception of 80 L1" locations. Exceptions are as followings: Measure 2" inward from each end. Two (2) 80 L1" top and bottom. Side locations are measured 2 ½" inward from each end. Remaining locations are 22" apart.

Elements for installing 82 steel door is as following: to inside web of 32" length of 44 top plate track; install a 32" length of 34 stud 3½" and fasten with 41 ½" #8 screws through flanges on each side. Now, measure 2" inward from each end and 14" apart. Three (3) screws are required for each side. Install pre-hung 82 steel door, measuring 2'8"× 2"×5'11" and secure frame to 44 top plate track with 37 ¾" #8 screws, measure 2" inward from each end and 14" apart. Three (3) screws are required. Fasten sides to 36 double stud. Measure 2½" inward from each end. Remaining screws are 22" apart. A total of four (4) screws are required. Other side is identical. 82 steel door has an 83 observation window of 45 1" Paltech is centered in door, from top of door, measure a distance of 1' down and center for 2×1"×2', 83 observation window has 1' square access section; which can only be opened from outside, and to the outside. This access window has electronic magnetic locking system.

Figure 6B:
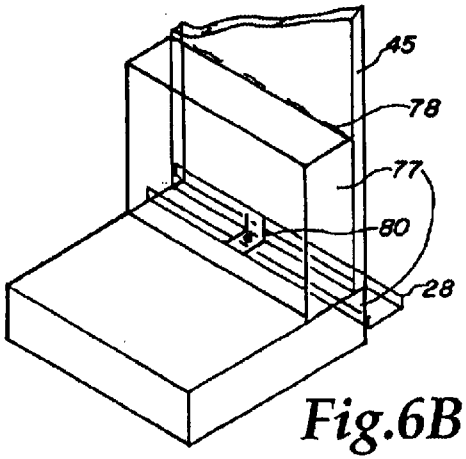
FIG. 6B is a sectional view of gauge steel bottom plate track for containment room.
Figure 6:
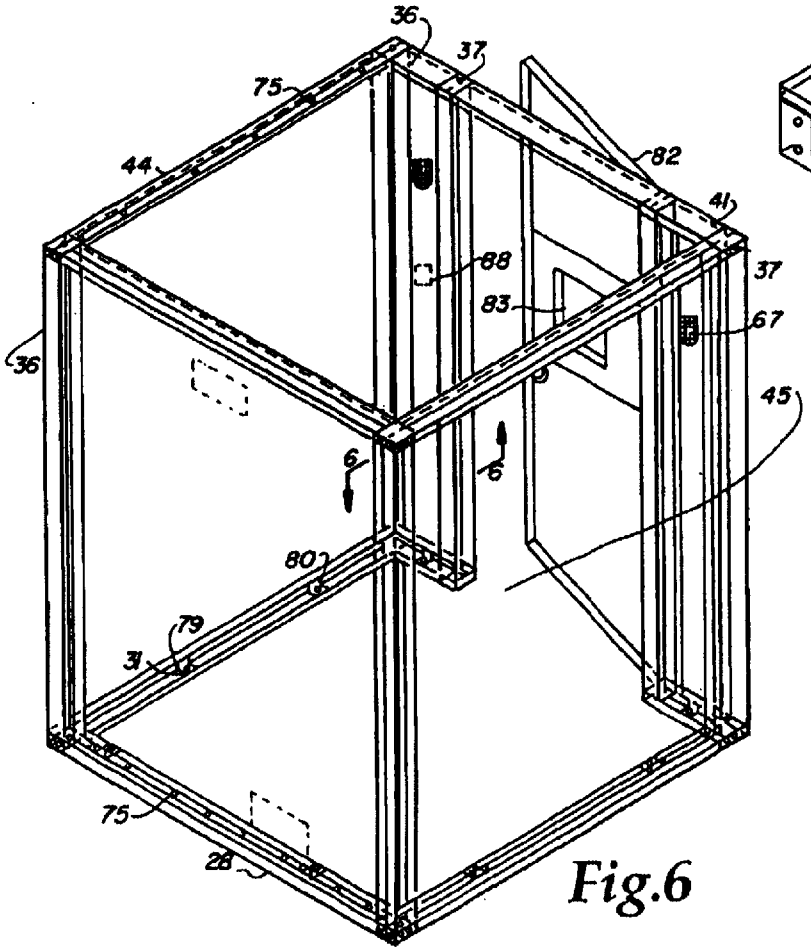
FIG. 6 is a perspective diagrammatic view of containment room assembly.

FIG. 6*b* Now, returning to inside containment room. The ceiling, entire wall, entire floor, and entire side of door, facing room is secured with industrial adhesive 77 8" of urethane padding with fire retardent cover; affixed to inside, to inside top of wall next to 83 steel door on both side is an 67 institutional steel case enclosed light fixture 88 double pole switch.

Figure 7:
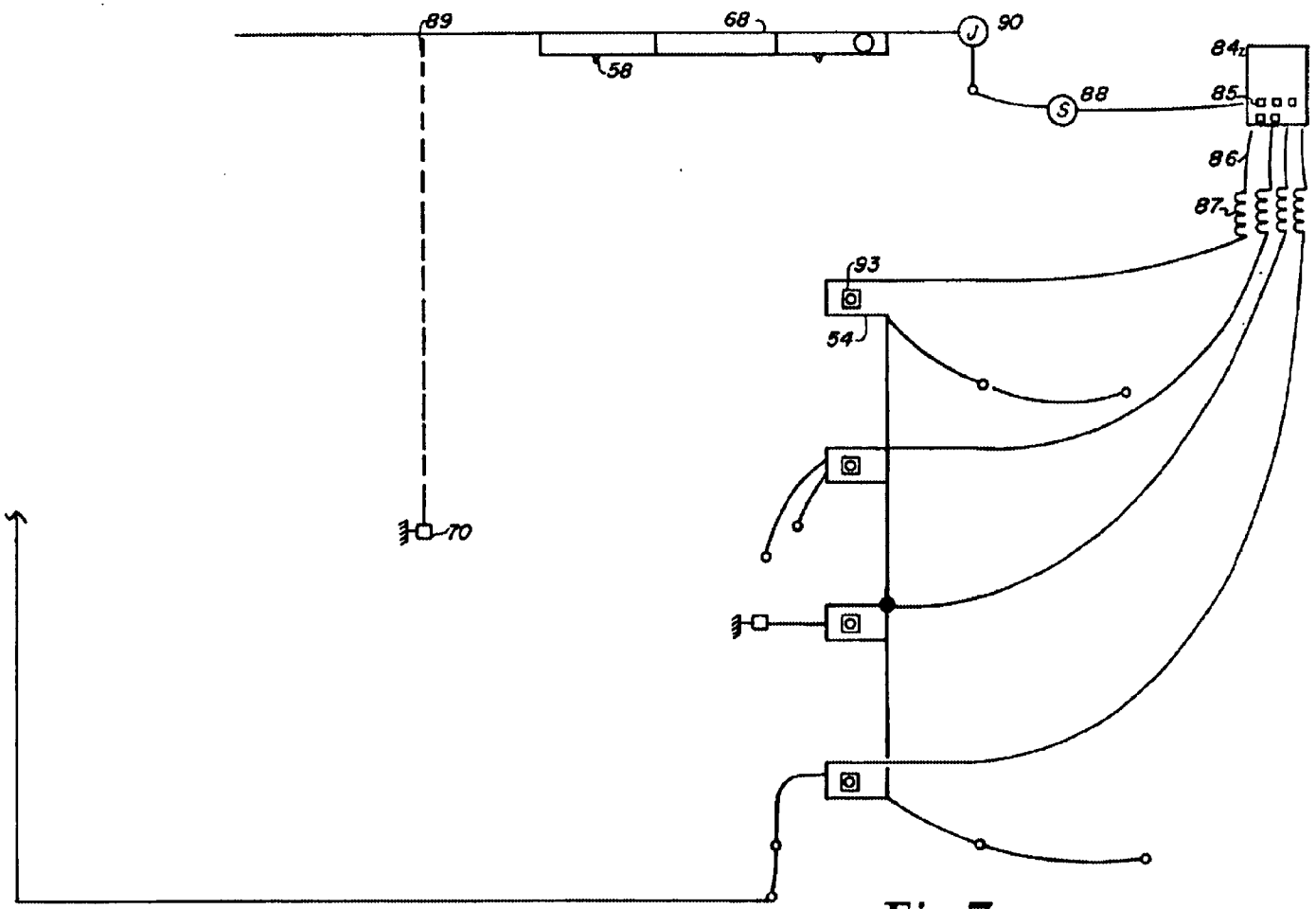
FIG. 7 is schematic view of conventional electrical wiring system.

FIG. 7 To existing 84 breaker panel, install 5 85 20 amp breakers. Connect to each breaker 86 #12–20, Romax cable. Run cables from 84 breaker panel and install 87. Step down transformers to each, 2' from breaker panel. Continue cable run to 54 electrical master control console, located behind "Lobby Banking Financial Security Chamber" teller wall as illustrated in FIG. 5. 3,7.

Standing behind FIG. 3, teller wall in front of teller window, facing chamber to the right hand side, install 88 single pole switch with receptacle to 36 double stud. Connect 86 No. 12–26, Romax cable to 88 single pole switch continue to run to top of 36 double stud and install to 90 junction box with cover, on top of 44 top plate track. Connect with 68 leaner track lighting system and 58 security chamber lens tracking system. Continue to run 86 NO. 12–26 Romax cable to 90 junction box located at the intersection of the center 39 horizontal interlocking beam and 44 top plate track. Run 89 branch circuit an connect to previously installed 70 fire sprinkler with water supplied from existing system.

Returning to teller window illustrated in FIG. 3, secure height adjustable, side leg brackets of 54 electrical master console to floor directly in front of teller window, using 75 powder driven fasteners 2 to each leg bracket, 54 electrical master control console mounts between brackets and can be rotated stopped and secure in place from a horizontal position to 45°. The 45° angle requires a minimum amount of foot motion necessary to activate this maximum security, invention.

Remove cover of 54 electrical master control console, exposing four 92 oxtogonal elect box's secured together with 41 ½" #8 low profile pan head screws to each box, eight (8) are required. The knockouts on 54 electrical master control console and 92 octagonal electrical boxes are aligned. Starting at the right hand end of 54 electrical master control console, run 86 cable 1-A-1, to 92 electrical box and connect to 93 SM/C with relay. This push bottom black switch No. 1 . Next, run 86 cable 1-A-3 to 93 SM/C momentary contact switch No. 3 Red, moving to your left, to the next 92 electrical box, run 86 cable 2-3-1, connect to 93 SM/C with relay; this is a push bottom green switch No. 2. Run 86 cable 2-b-2 to 66 steel drop doors and lock actuators. Run 89 branch circuit 2-B-3 to basement and install 67 institutional steel cased includes light fixture mounted to inside wall of FIG. 6, containment room. Run 2-B-3 to outside wall and install 88 single pole switch. Continue to run 86 cable 2-B-4 out of 92 electrical box and connect into 86 cable 1-A-3.

Moving to the next 92 electrical box, run 86 cable 3-C-1 and connect to 93 SM/C with relay; this is push bottom red alarm switch no.3. Connect 86 cable 1-A-3 and 86 cable 4-D-4 to 86 cable 3-C-3 and connect 86 cable 3-C-2 to alarm system.

Moving to the 92 electrical box, run 86 cable 4-D-1 and connect to 93 SM/C with relay, this push button white switch no.4. Now, run 86 cable 4-D-1 and connect to 86 cable 4-D-2. Run this cable up and along 44 top plate track to 74 entrance doors and lock actuators. Run 86 cable 4-D-3 to 56 pepper gas spray head's. Connect 86 cable 4-D-4 to 86 cable 4-D-3 components are conventional, and are interconnected to the bank's emergency standby electrical power source.

Figure 8:
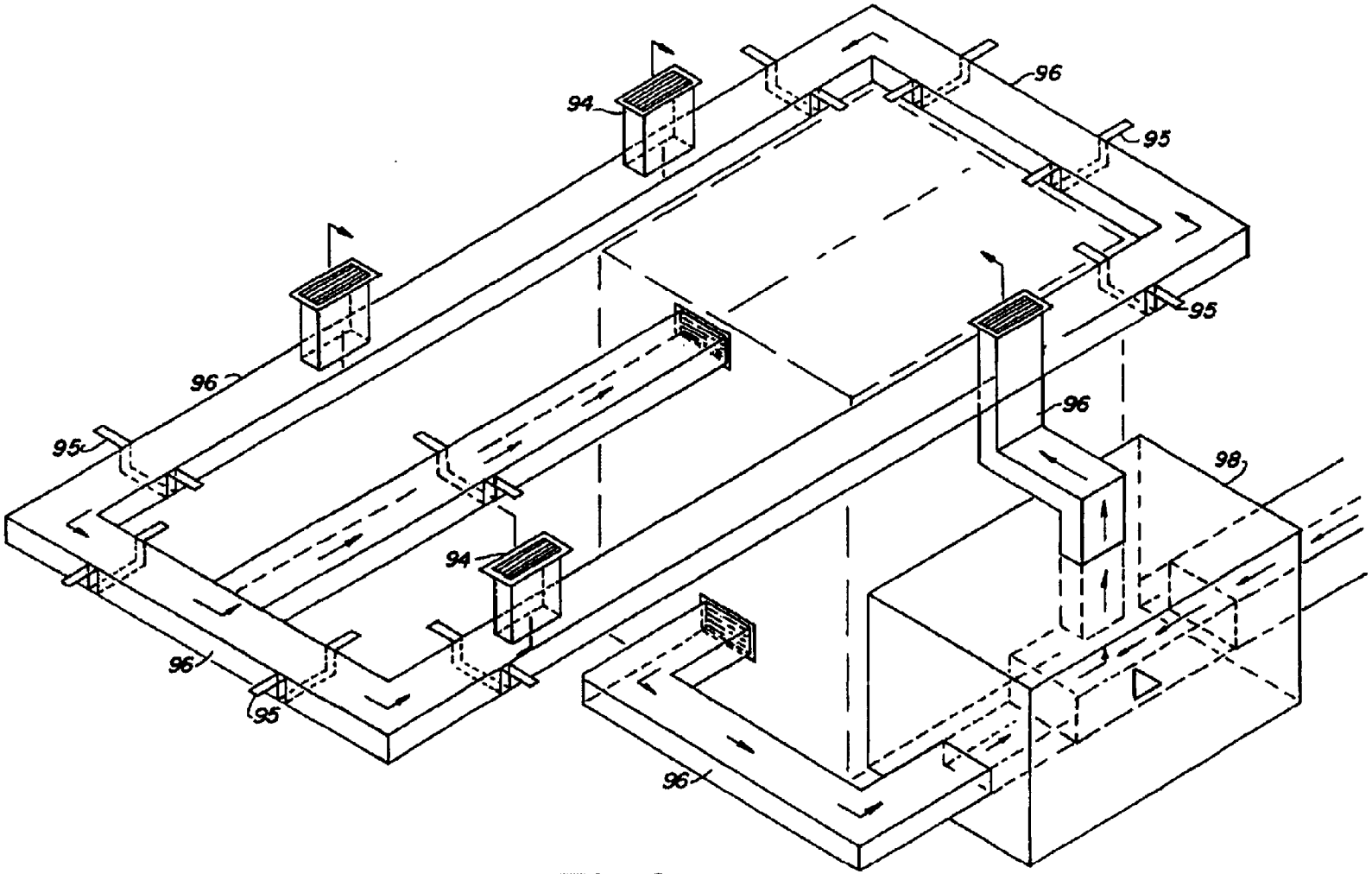
FIG. 8 is a schematic view of conventional filtration unit for building.

FIG. 8 A loop air distribution system will be used to heat and cool both overview of Lobby Banking Financial Security Transaction chamber's and FIG. 6 containment room.

The 96 supply duct loop, will be secured to basement ceilings and will run the perimeter of the overview. Pre-cut 4 openings in chamber floor to accept 94 register. Now, measure in from inside walls 5'. Measure in vertical direction 4' and 9' along one wall, mark these locations. On opposite wall, measure 2'6" and 7'2", mark locations. Measure 6" on either side of these marks. From this line measure 4" horizontal and strike another vertical line. This will create opening for 94 register. These offset 94 registers will provide a more even air distribution. The are four (4) 94 registers.

In basement install 96 supply duct loop to ceiling using 95 Aluminum Brackets every 1'6" from each corner and one at 8' on both sides. This duct work is conventional square and insulated from manufacture, with 97 riser's to 94 registers installed. Fasten with 75 powder driven fasteners, as required. On the back wall of FIG. 6, cut openings for 94 register and install. This 94 register is located 1' down from top of FIG. 6 and 1'6" inward from of left side. Cut openings and install register seal with 21 epoxy resin. Continue to the bottom of this wall, measure up 1' from bottom and 2' in from left corner edge. Cut openings and install 94 registers, seal with 21 epoxy resin. Continue with this 96 duct loop to 98 air filtration unit and connect 98 air filtration unit is conventional and is installed to the left side of FIG. 6 containment room and is connected to existing unit. Air from existing unit comes in through 98 air filtration unit circulates through overview of chamber and FIG. 6 containment room returns to 98 air filtration unit is cleaned and recirculated Electrical Power is connected to existing power source. All components are conventional.

FIG. 9 Teller drive through window is based on existing bank teller drive through window, which is part of main bank building. Teller window being housed within main building.

Remove all existing glass and frame work. Install 44 top plate track flange turned up and bottom plate track flange turned down. Each begin 8'8" in length, fasten through web to window header and sill using 37 ¾" #8 LPPH, screws. Measure inward from each end 4" and mark. Then measure and mark every 25". There will be six (6) screws needed for each track. Cut and install to the sides of window frame 2 lengths of 34 stud 2'7½". Butt between 44 and 28 bottom plate track secure through web to wall sides. Using 37 ¾" #8 LPPH, measure 2" inward from each end of each length, then measure and mark every 9" and six (6) screws are needed for each side.

Standing on the inside of FIG. 9, looking out through window, install to the outside edge of 44 top plate track 79 L2"×2"×¼"×8'7½". Turn inside of angle facing to the inside of window, fasten with 41 ½" #8 LPPH screws. This 8'7½" length will be cut and install in three (3) sections, two (2) sections will be 2'8" and one (1) section will be 24" in length. Screw spacing on 2'8" length is: 2¼" inward from each end; then measure 17", there are three (3) screws required for each length. For the 24" length, measure 2" in from each end, then measure 10"; three (3) screws are required. Installation to 28 bottom plate track is identical.

We will now install to sides install 79 L2"×2"×¼"×2'7" one length for each side 2'7" long, turn angle to inside of window. On each 2" leg, on both lengths, cut and remove a 2" length. This is to allow side sections to mate with top and bottom 79 angles. Fasten to sides with 31 ¾" #10 LPPH screws. Measure in from each end 2" then measure 9" apart; four (4) screws are required, for each side.

Now, install factory fabricated and framed sheet of 45 1" Peltech. This sheet is 8'7"×2'7"; 3'2½" inward from each end of this panel, we will find 2 vertical panels pre-framed 45 1" Peltech panels 16"×1"×2'7". These have been sandwiched between the horizontal panel. These panels are hinged which allows them to be closed and secured. They will rest on 108 which is the outside window counter. Apply 63 epoxy sealer to all edges of panel and lift in place, sliding 45 1" panels through 1¼" openings that were left open when 79 L2"×2"×¼×8'7½" was installed to 44 top plate track and 28 bottom plate track. Press and secure this panel to 79 with 100 1¼" #10 LPPH head screws. Top and bottom of panel screw spacing are 2" inward from each end toward center. Remaining screws are 11" apart. Eleven (11) screws are required. Side screw spacing is 2½" inward from each end toward center, remaining screws are 13" apart; four (4) screws required. Install factory framed sliding 45 1" Peltech panels. Butt frame to previously installed 45 1' Peltech panel. Fasten frame top and bottom with 41 ½" #8 LPPH, screw 2" inward from each end toward center. Remaining screws are 11" apart. Eleven (11) screws each are required top and bottom. Install to each side measure, 2" inward from each end toward center remaining screws are 9" apart. Five (5) screws are required on each side.

58 Pepper gas spray heads are mounted inside 108 Hollan Stainless Steel window counter and are set at 45 angles toward customer's face. Also mounted inside the counter will be a 102 customer phone which raises for use when button is pressed and retracts when not in use. 110 teller drawer phone and 56 pepper gas spray heads have sliding automatic steel covers which secures them when bank is closed. To the top of the inside window, will be a 58 security camera lens security track system installed facing the walk up window, and teller drive through module with the FIG. 9 drive through banking system.

Inside FIG. 9 Teller drive through banking window, to the underneath edge of the teller counter, there are two (2) 93 momentary contact switches black push button open or close window, the red one closes window, activates alarm and pepper spray. This enable the teller to protect themselves and the bank, sound the alarm and 56 pepper spray and a would be assailant. These are wired into the existing electrical system.

The 103 communication console is located in the FIG. 9 teller driver through window area, directly beneath the customer service window. The 103 communication console, base is equipped with pa-lamps that correspond to each alpha-numeric coded drive through lane.

When customer activates 104 receiver 103 lights indicating, drive throughout lane. All teller's will wear 101 when communications are completed and 104 is replaced privacy communication channel automatically closes. The 104 receiver and 101 head set communication create a privacy system, that cannot be overhear by the public. All drive through will be connected to 105 with 105 CATV-V cable to prevent cross talk.

Figure 10:
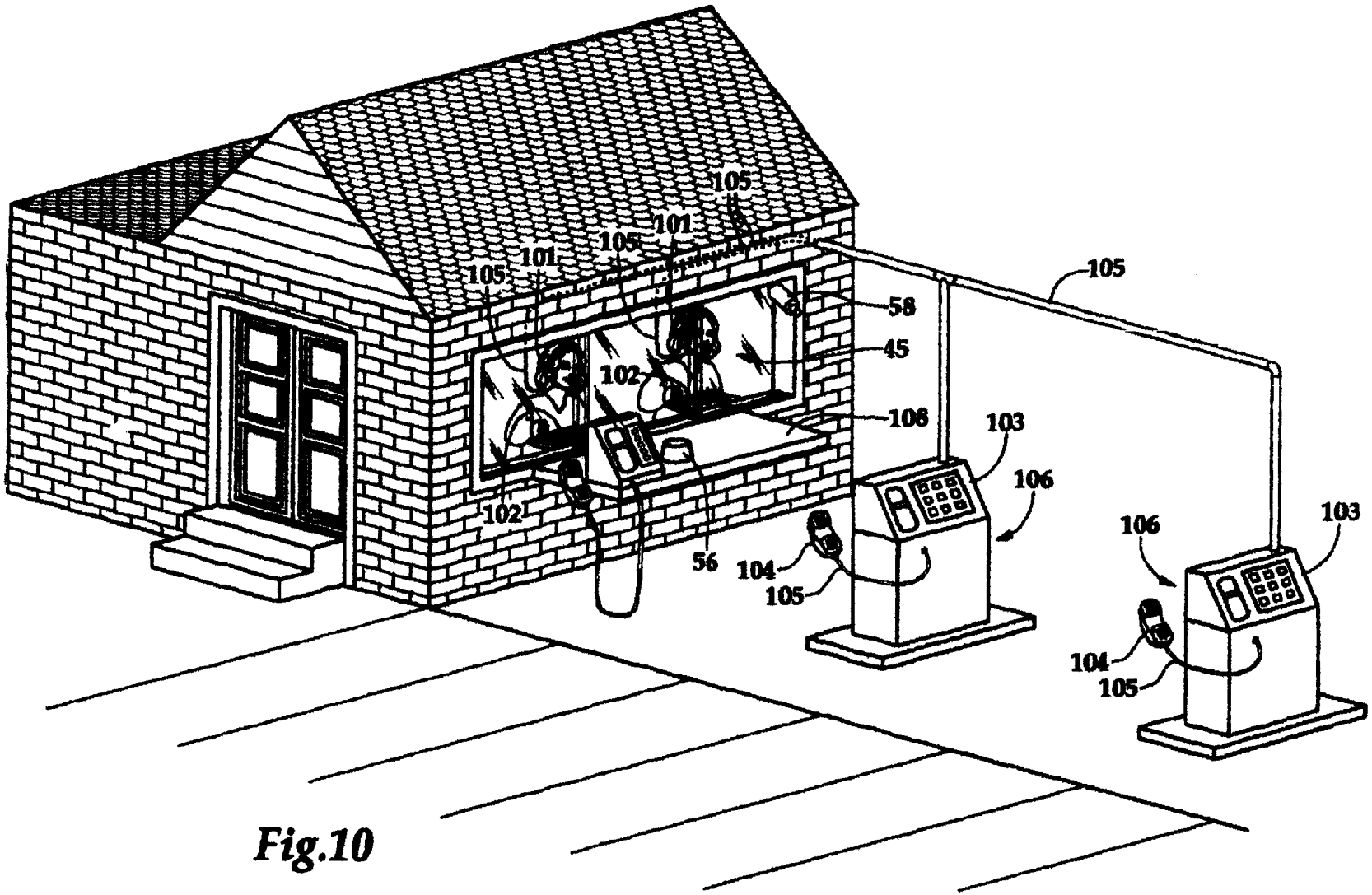
FIG. 10 is a illustrative overview of the lobby banking financial security transaction and interconnected privacy telecommunication drive-in, drive-through channels.

FIG. 9A and FIG. 10 Teller drive-through module built in the existing communication will be removed and replaced 104 by touch tone phone, receiver will be mounted next to each depository in each 9A teller drive-through module. Each 104 touch tone receiver is connected to 103 communication console, located in the FIG. 9 area and has it's own alpha numeric code. Customer picks up 104 touch tone phone receiver, hears dial tone, dials in proper alpha numeric numbers, console lights up, teller communicates, customer communicates, customer hangs up breaking connection. Teller can contact customer by activating a ringing tone to that 104 touch tone phone receiver, 105 communication console is used to prevent cross talk and is wired to existing electrical system, 104 each teller drive-through module is identical.

As shown in FIG. 10 particular references are enhanced showing security for bank teller. Closed circuit control of all verbal conversation between customer and bank teller with financial transactions.

I claim:

1. An improved telecommunication system for a bank powered by electrical system of, said bank, and including a CATV-V cable wiring system, said telecommunication comprising:

communication control base member mounted interiorly of said bank at a teller's window, money depository module located at a customer's vehicle drive-in lane, a telephone unit positioned on a shelf exteriorly adjacent a teller's window provided for a walk-in customer, and an emergency alarm system, said telecommunication system cooperably adaptable so that:

the communication control base member is operably connected to:

a telephone component at a teller's window, contact controls for communication with a touch-tone phone at a monetary depository module, a touch-tone phone at a walk-in customer window, control means to open and close a teller's window, an emergency alarm system including a sound alarm and a security camera, activate a pepper spray system at a walk-in customer window, a pa-lamp corresponding to a signal at a monetary depository module, and an identification signal for identifying a drive-in lane, and the money depository module comprises:

a touch-tone phone connectible to said control base member by means of said CATV-V cable wiring system, said phone having retractable flexible cord to permit a customer to speak to a teller while said customer is seated in his vehicle.

* * * * *